US012352115B1

(12) United States Patent
Al-Mousa

(10) Patent No.: US 12,352,115 B1
(45) Date of Patent: Jul. 8, 2025

(54) WELLBORE TUBULAR CENTRALIZER TOOL

(71) Applicant: Saudi Arabian Oil Company, Dhahran (SA)

(72) Inventor: Ahmed Abdulaziz Al-Mousa, Doha (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/408,027

(22) Filed: Jan. 9, 2024

(51) Int. Cl.
*E21B 17/10* (2006.01)
*E21B 19/24* (2006.01)

(52) U.S. Cl.
CPC ..... *E21B 17/10* (2013.01); *E21B 19/24* (2013.01)

(58) Field of Classification Search
CPC ..... E21B 17/10; E21B 19/24
See application file for complete search history.

(56) References Cited

U.S. PATENT DOCUMENTS 1,820,391 A * 8/1931 Hartman ..... E21B 17/1028 166/241.4
2,605,844 A * 8/1952 Clark, Jr. ..... E21B 17/1028 166/241.7
2,738,019 A * 3/1956 Atkinson ..... E21B 17/1028 166/213
2,845,128 A * 7/1958 Clark, Jr. ..... E21B 37/02 166/173
3,566,965 A * 3/1971 Solum ..... E21B 17/1028 166/241.7
3,749,168 A * 7/1973 Hall, Sr. ..... E21B 17/1028 166/241.7
4,159,742 A * 7/1979 Alexander, Jr. ..... E21B 37/02 166/173
4,651,823 A * 3/1987 Spikes ..... E21B 17/1028 166/241.7
4,909,322 A * 3/1990 Patterson ..... E21B 17/1028 166/241.7
8,770,280 B2 7/2014 Buytaert et al.
8,991,487 B2 3/2015 Levie et al.
10,047,574 B2 * 8/2018 Jenner ..... E21B 17/1028
D851,131 S * 6/2019 Jenner ..... D15/21

(Continued)

FOREIGN PATENT DOCUMENTS

CA 2550096 9/2009
CA 2634287 12/2010
GB 2449566 11/2008

OTHER PUBLICATIONS

U.S. Appl. No. 18/456,950, Powering a Packer and an Electrical Submersible Pump, filed Aug. 28, 2023, 30 pages.

(Continued)

*Primary Examiner* — Steven A MacDonald
(74) *Attorney, Agent, or Firm* — Fish & Richardson P.C.

(57) ABSTRACT

A centralizer tool includes a top clamp including a top split ring and a top lock assembly configured to adjust the top clamp from an unlocked position and a locked position; a bottom clamp including a bottom split ring and a bottom lock assembly configured to adjust the bottom clamp from an unlocked position and a locked position; and at least one bow attached to the top split ring and the bottom split ring, the bow including a contact surface configured to contact a rock formation in a wellbore.

18 Claims, 6 Drawing Sheets

(56) References Cited

U.S. PATENT DOCUMENTS

| | | | | |
|---|---|---|---|---|
| D873,867 | S * | 1/2020 | Neel | D15/21 |
| 10,626,698 | B2 | 4/2020 | Al-Mousa et al. | |
| 10,837,254 | B2 | 11/2020 | Al-Mousa et al. | |
| 10,975,645 | B2 | 4/2021 | Al-Mousa et al. | |
| 10,975,654 | B1 | 4/2021 | Neacsu et al. | |
| 10,982,504 | B2 | 4/2021 | Al-Mousa et al. | |
| 11,008,824 | B2 | 5/2021 | Al-Mousa et al. | |
| 11,035,190 | B2 | 6/2021 | Neacsu et al. | |
| 11,105,180 | B2 | 8/2021 | Al-Mousa et al. | |
| 11,136,849 | B2 | 10/2021 | Al-Mousa et al. | |
| 11,142,976 | B2 | 10/2021 | Al-Mousa et al. | |
| 11,156,052 | B2 | 10/2021 | Al-Mousa et al. | |
| 11,225,850 | B2 | 1/2022 | Al-Mousa et al. | |
| 11,230,904 | B2 | 1/2022 | Al-Mousa et al. | |
| 11,268,330 | B2 | 3/2022 | Al-Mousa et al. | |
| 11,274,549 | B2 | 3/2022 | Al-Mousa et al. | |
| 11,286,725 | B2 | 3/2022 | Al-Mousa et al. | |
| 11,326,405 | B2 | 5/2022 | Al-Mousa et al. | |
| 11,391,107 | B2 | 7/2022 | Al-Mousa et al. | |
| 11,391,113 | B2 | 7/2022 | Al-Mousa et al. | |
| 11,401,763 | B2 | 8/2022 | Al-Mousa et al. | |
| 11,421,502 | B2 | 8/2022 | Neacsu et al. | |
| 11,448,026 | B1 | 9/2022 | Al-Mousa et al. | |
| 11,448,028 | B2 | 9/2022 | Al-Mousa et al. | |
| 11,525,322 | B2 | 12/2022 | Neacsu et al. | |
| 11,549,329 | B2 | 1/2023 | Al-Mousa et al. | |
| 11,585,177 | B2 | 2/2023 | Al-Mousa et al. | |
| 11,598,178 | B2 | 3/2023 | Al-Mousa et al. | |
| 11,655,685 | B2 | 5/2023 | Al-Mousa et al. | |
| 11,697,974 | B2 | 7/2023 | Al-Mousa et al. | |
| 11,808,113 | B2 | 11/2023 | Al-Mousa | |
| 11,828,128 | B2 | 11/2023 | Al-Mousa et al. | |
| 11,898,439 | B2 | 2/2024 | Al-Mousa et al. | |
| 11,901,800 | B1 | 2/2024 | Al-Mousa | |
| 11,905,791 | B2 | 2/2024 | Al-Mousa | |
| 11,913,298 | B2 | 2/2024 | Al-Mousa | |
| 11,933,130 | B2 | 3/2024 | Al-Mousa et al. | |
| 11,933,163 | B1 | 3/2024 | Al-Mousa | |
| 11,946,336 | B1 | 4/2024 | Al-Mousa et al. | |
| 11,952,876 | B2 | 4/2024 | Al-Mousa et al. | |
| 11,993,992 | B2 | 5/2024 | Al-Mousa | |
| 12,024,985 | B2 | 7/2024 | Al-Mousa et al. | |
| 2003/0178193 | A1* | 9/2003 | Hennessey | E21B 17/1028 166/241.6 |
| 2008/0264629 | A1* | 10/2008 | Buytaert | E21B 17/1028 166/241.7 |
| 2012/0312552 | A1* | 12/2012 | Rayssiguier | E21B 17/023 166/380 |
| 2013/0248206 | A1* | 9/2013 | Jordan | E21B 17/1078 166/241.1 |
| 2013/0319689 | A1* | 12/2013 | Levie | E21B 17/1028 166/241.6 |
| 2014/0311756 | A1* | 10/2014 | Dicke | C23C 12/00 427/236 |
| 2015/0368990 | A1* | 12/2015 | Jewett | E21B 17/1014 166/241.6 |
| 2016/0326813 | A1* | 11/2016 | Miller | B21D 22/025 |
| 2020/0232316 | A1 | 7/2020 | Neacsu et al. | |
| 2022/0275692 | A1 | 9/2022 | Al-Mousa | |
| 2023/0167722 | A1 | 6/2023 | Al-Mousa et al. | |
| 2023/0184057 | A1 | 6/2023 | Al-Mousa | |
| 2023/0250708 | A1 | 8/2023 | Al-Mousa | |
| 2023/0356491 | A1 | 11/2023 | Al-Mousa | |
| 2024/0141758 | A1 | 5/2024 | Al-Mousa | |
| 2024/0052742 | A1 | 8/2024 | Al-Mousa et al. | |

OTHER PUBLICATIONS

U.S. Appl. No. 18/162,862, Al-Mousa et al., Closing Inflow Control Device Using Dissolvable Balls and Plugs, filed Feb. 1, 2023, 26 pages.

U.S. Appl. No. 18/332,397, Al-Mousa, Non-Metallic Liner for Wellbore Sidetrack Operations, filed Jun. 9, 2023, 23 pages.

U.S. Appl. No. 18/667,229, Al-Mousa et al., Whipstock to Plug and Abandon Wellbore Below Setting Depth, filed May 17, 2024, 22 pages.

* cited by examiner

WELLBORE TUBULAR CENTRALIZER TOOL

TECHNICAL FIELD

This disclosure relates to a centralizer tool for a wellbore tubular, such as a casing.

BACKGROUND

In drilling and workover operations, a wellbore tubular, such as a casing, can be installed in an open hole wellbore and used to isolate and protect against the migration of wellbore fluids through the wellbore. In some cases, during the installation of the casing, a lower casing section might pack off, resulting in losing a casing shoe into the open hole wellbore, which is not easily retrieved.

SUMMARY

In an example implementation, a centralizer tool includes a top clamp including a top split ring and a top lock assembly configured to adjust the top clamp from an unlocked position in which the top split ring is open to receive a first portion of a wellbore tubular and a locked position in which the top split ring is closed to secure the first portion of the wellbore tubular in the top clamp; a bottom clamp including a bottom split ring and a bottom lock assembly configured to adjust the bottom clamp from an unlocked position in which the bottom split ring is open to receive a second portion of the wellbore tubular and a locked position in which the bottom split ring is closed to secure the second portion of the wellbore tubular in the bottom clamp; and at least one bow attached to the top split ring and the bottom split ring, the bow including a contact surface configured to contact a rock formation in a wellbore.

In an aspect combinable with the example implementation, the at least one bow includes a plurality of bows.

In another aspect combinable with any of the previous aspects, each bow is attached to the top split ring and the bottom split ring.

In another aspect combinable with any of the previous aspects, each bow of the plurality of bows is radially offset from adjacent bows by a particular distance.

In another aspect combinable with any of the previous aspects, a circumference defined by the contact surfaces of the plurality of bows is greater than a circumference defined by the top clamp in the locked position and a circumference defined by the bottom clamp in the locked position.

In another aspect combinable with any of the previous aspects, each of the top split ring and the bottom split ring includes at least one outer slips coupled to an outer surface and configured to contact the rock formation in the wellbore.

In another aspect combinable with any of the previous aspects, each of the top split ring and the bottom split ring includes at least one inner slips coupled to an inner surface and configured to contact the wellbore tubular.

In another aspect combinable with any of the previous aspects, the top lock assembly includes a first set of sleeves and a second set of sleeves and a first pin configured to fit through the first and second set of sleeves in an interlocked position to adjust the top clamp into the locked position.

In another aspect combinable with any of the previous aspects, the bottom lock assembly includes a third set of sleeves and a fourth set of sleeves and a second pin configured to fit through the third and fourth set of sleeves in an interlocked position to adjust the bottom clamp into the locked position.

In another aspect combinable with any of the previous aspects, the first pin includes a leg that forms a U to retain the first pin within the first and second sets of sleeves in the interlocked position.

In another aspect combinable with any of the previous aspects, the second pin includes a leg that forms a U to retain the second pin within the third and fourth sets of sleeves in the interlocked position.

In another aspect combinable with any of the previous aspects, the top split ring includes two half-rings joined by a top hinge, and the top lock assembly includes the first set of sleeves connected to one of the two half rings and the second set of sleeves connected to the other of the two half-rings of the top split ring.

In another aspect combinable with any of the previous aspects, the bottom split ring includes two half-rings joined by a bottom hinge, and the bottom lock assembly includes the third set of sleeves connected to one of the two half rings and the fourth set of sleeves connected to the other of the two half-rings of the bottom split ring.

In another aspect combinable with any of the previous aspects, the wellbore tubular includes a production casing joint.

In another example implementation, a method of installing a wellbore tubular includes positioning a wellbore tubular over an entry of a wellbore; inserting a first portion of the wellbore tubular into a top clamp of a centralizer tool while the top clamp is in an unlocked position to receive the first portion of the wellbore tubular within a top split ring of the top clamp; adjusting the top clamp from the unlocked position to a locked position with a top lock assembly of the top clamp to secure the first portion of the wellbore tubular in the top split ring of the top clamp; inserting a second portion of the wellbore tubular into a bottom clamp of the centralizer tool while the bottom clamp is in an unlocked position to receive the second portion of the wellbore tubular within a bottom split ring of the bottom clamp; adjusting the bottom clamp from the unlocked position to a locked position with a bottom lock assembly of the bottom clamp to secure the second portion of the wellbore tubular in the bottom split ring of the bottom clamp; running the wellbore into the wellbore; and during the running, maintaining a space between a rock formation of the wellbore and the wellbore tubular with at least one bow attached to the top split ring and the bottom split ring and including a contact surface configured to contact the rock formation in the wellbore.

In an aspect combinable with the example implementation, maintaining a space between a rock formation of the wellbore and the wellbore tubular with at least one bow attached to the top split ring and the bottom split ring includes maintaining the space between the rock formation of the wellbore and the wellbore tubular with a plurality of bows attached to the top split ring and the bottom split ring.

Another aspect combinable with any of the previous aspects includes maintaining the space between the rock formation of the wellbore and the wellbore tubular with the plurality of bows attached to, and radially offset around, the top split ring and the bottom split ring by a particular distance.

Another aspect combinable with any of the previous aspects includes maintaining the space between the rock formation of the wellbore and the wellbore tubular with the plurality of bows at a circumference defined by the contact surfaces of the plurality of bows that is greater than a circumference defined by the top clamp in the locked position and a circumference defined by the bottom clamp in the locked position.

Another aspect combinable with any of the previous aspects includes contacting the rock formation with at least one outer slips coupled to each of the top split ring and the bottom split ring.

Another aspect combinable with any of the previous aspects includes securing the first and second portions of the wellbore tubular in the top clamp and the bottom clamp, respectively, with at least one inner slips coupled to an inner surface of each of the top split ring and the bottom split ring.

In another aspect combinable with any of the previous aspects, adjusting the top clamp from the unlocked position to a locked position with a top lock assembly includes securing a first pin into interlocked first and second sets of sleeves of the top lock assembly, and adjusting the bottom clamp from the unlocked position to a locked position with a bottom lock assembly includes securing a second pin into interlocked third and fourth sets of sleeves of the bottom lock assembly.

Another aspect combinable with any of the previous aspects includes retaining the first pin within the first and second sets of sleeves in the interlocked position with a leg that forms a U.

Another aspect combinable with any of the previous aspects includes, retaining the second pin within the third and fourth sets of sleeves in the interlocked position with a leg that forms a U.

Another aspect combinable with any of the previous aspects includes securing the first portion of the wellbore tubular in the top split ring of the top clamp by closing the top split ring at a top hinge of the top split ring to interconnect the first set of sleeves on one half of the top split ring with the second set of sleeves on another half of the top split ring.

Another aspect combinable with any of the previous aspects includes securing the second portion of the wellbore tubular in the bottom split ring of the bottom clamp by closing the bottom split ring at a bottom hinge of the bottom split ring to interconnect the third set of sleeves on one half of the bottom split ring with the fourth set of sleeves on another half of the bottom split ring.

In another aspect combinable with any of the previous aspects, the wellbore tubular includes a production casing joint.

Implementations of a centralizer tool for a wellbore tubular according to the present disclosure may include one or more of the following features. For example, implementations according to the present disclosure can reduce or eliminate loss of a casing show in an open hole wellbore as the result of casing packoff. As another example, implementations according to the present disclosure can reduce abandonment of wellbores due to loss of casing shoes.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes implementations of a centralizer tool that can couple to a portion of a wellbore tubular, such as a casing, during installation of the tubular into a wellbore. Example implementations of the centralizer tool, when installed on the wellbore tubular, can prevent contact between the wellbore tubular and a rock formation of the wellbore by maintaining a particular distance (radial) between the rock formation and the wellbore tubular during movement of the tubular in the wellbore. In some aspects, the centralizer tool maintains the wellbore tubular largely centered (radially) in the wellbore during movement and can be easily and quickly installed on the wellbore tubular at the rig floor. By keeping the wellbore tubular largely centered in the wellbore, example implementations of the centralizer tool can prevent packing off the wellbore tubular (such as the casing).

Figure 1A:
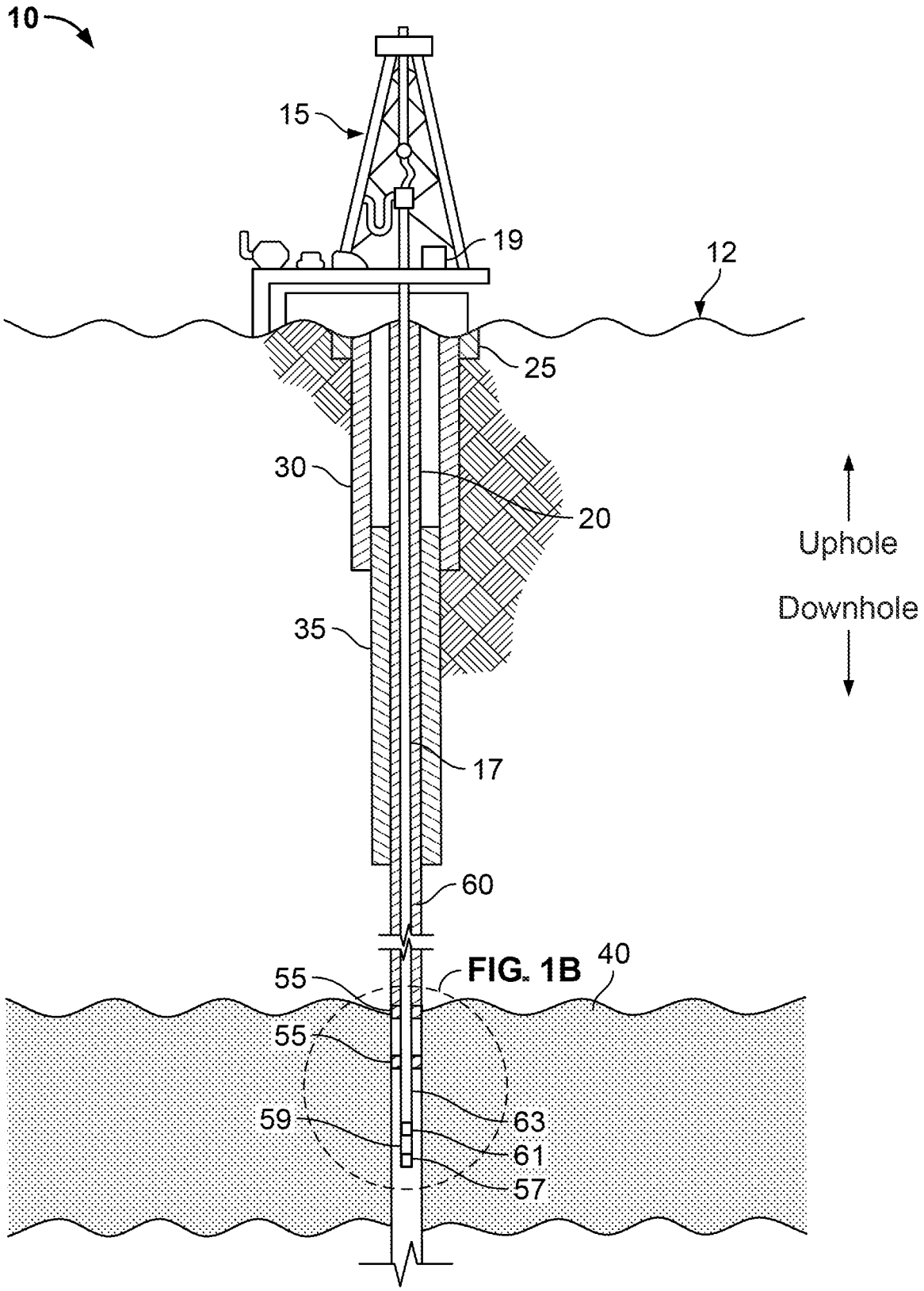
FIGS. 1A and 1B are schematic diagrams of an example wellbore system that includes at least one centralizer tool for a wellbore tubular according to the present disclosure.
Figure 1B:
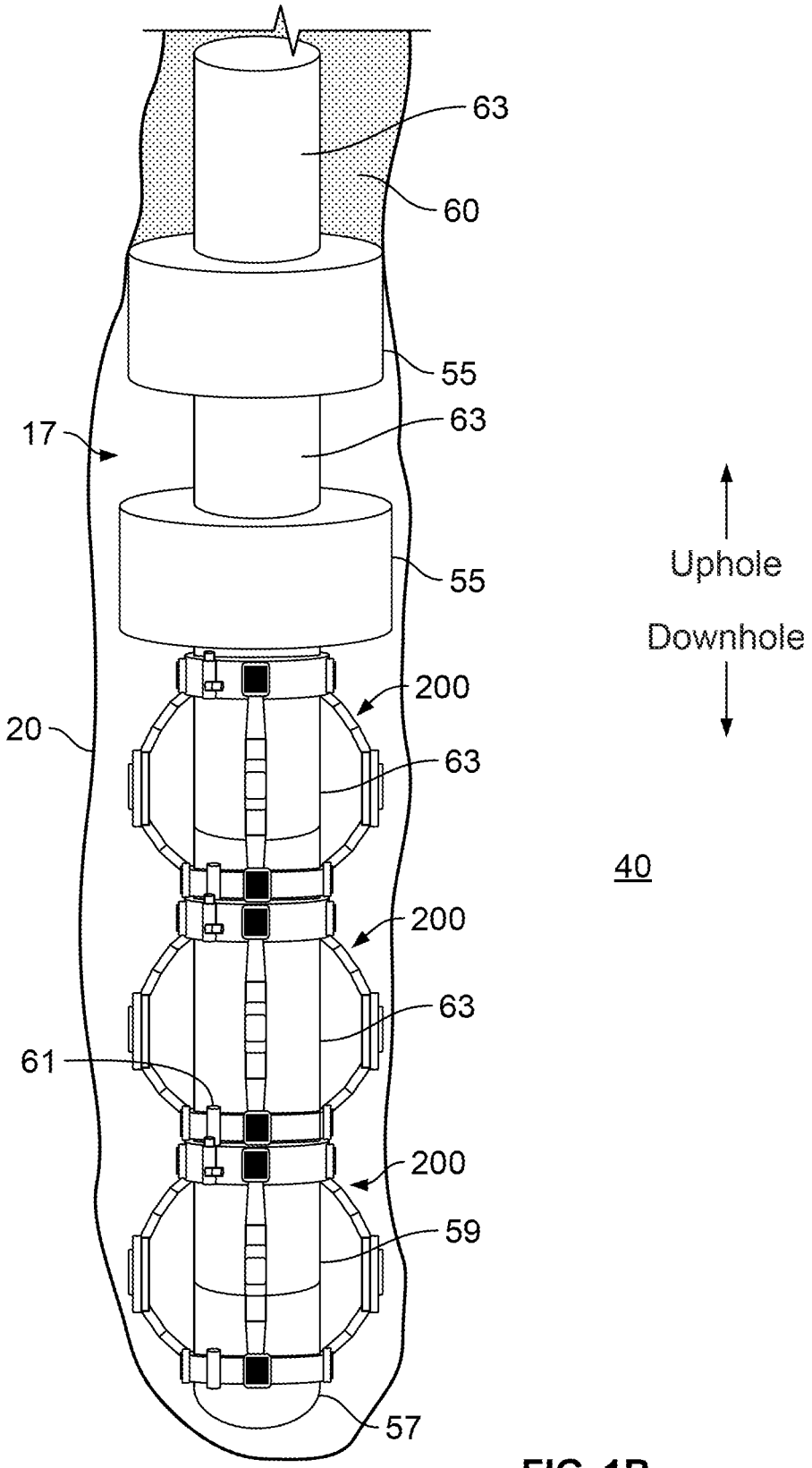

FIGS. 1A and 1B are schematic diagrams of an example wellbore system 10 that includes at least one centralizer tool 200 for a wellbore tubular according to the present disclosure. As shown more specifically in FIG. 1B (which shows a closer view of a portion of the wellbore system 10), one or more centralizer tools 200 can be installed on portions of a wellbore tubing string 17 that, among other components, is made up of casing joints 63 that are coupled (for example, threadingly) together to form the string 17.

As shown, the wellbore system 10 accesses a subterranean formation 40, and provides access to hydrocarbons located in such subterranean formation 40, also called reservoir 40. In an example implementation of system 10, the system 10 may be used for a drilling operation as well as a production operation to produce hydrocarbons through the wellbore tubular string. However, in some aspects, system 10 does not include a drilling rig but does include a wellhead with one or more surface valves as well as a valve control system to control the surface valves, one or more downhole smart valves, or both.

As illustrated in FIG. 1A, an implementation of the wellbore system 10 includes a completion assembly (or "assembly") 15 deployed on a terranean surface 12. The assembly 15 can generally represent a drilling assembly that can be used to form the wellbore 20 extending from the terranean surface 12 and through one or more geological formations in the Earth, as well as a production assembly to produce hydrocarbons, water, or both from the one or more geological formations. One or more subterranean formations, such as subterranean formation 40, are located under the terranean surface 12. One or more wellbore casings, such as a surface casing 30 and intermediate casing 35, may be installed in at least a portion of the wellbore 20 (for example subsequent to completion of the drilling operation or some other time).

In some embodiments, the assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

Generally, as a drilling system, the assembly 15 may be any appropriate assembly or drilling rig used to form wellbores or boreholes in the Earth. The assembly 15 may use traditional techniques to form such wellbores, such as the wellbore 20, or may use nontraditional or novel techniques. In some embodiments, the drilling assembly 15 may use rotary drilling equipment to form such wellbores. Rotary drilling equipment is known and may consist of a drill string and a drill bit (or bottom hole assembly that includes a drill bit). In some embodiments, the assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string. The drill string is typically attached to the drill bit (for example, as a bottom hole assembly). A swivel, which is attached to hoisting equipment, carries much, if not all of, the weight of the drill string, but may allow it to rotate freely.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

As a production assembly, the assembly 15 can include certain aforementioned components, as well as the wellbore tubular string 17, or production string 17, through which a production fluid (for example, hydrocarbons, water, or a combination thereof) can be produced from subterranean formation 40 to the terranean surface 12. As shown in this example of FIGS. 1A and 1*i*, the production tubing 17 includes casing joints 63 made up along with, at a downhole end of the string 17, a landing collar 61, a float collar 59, and a casing shoe 57. One or more production seals 55 (such as production tubing packers) can be installed on the production string 17 as shown in order to hold particular components of the string 17 in place in the wellbore 20.

As shown in this example, cement 60 is installed in an annulus between the production string 17 and other casings or the wellbore 20, itself, in open hole portions. Turning to FIG. 1B in particular, the centralizer tools 200 can be installed at or near the landing collar 61, the float collar 59, and the casing shoe 57 in order to maintain a radial distance between such components (as well as casing joints 63) and a wall of the wellbore 20 that comprises the subterranean formation 40. Due to, for instance, a drilling process that forms the wellbore 20 in an uneven fashion, the centralizer tools 200 may contact a certain portion of the wall of the wellbore 20 while still maintaining a distance from the wellbore 20 as shown in FIG. 1B.

Figure 2:
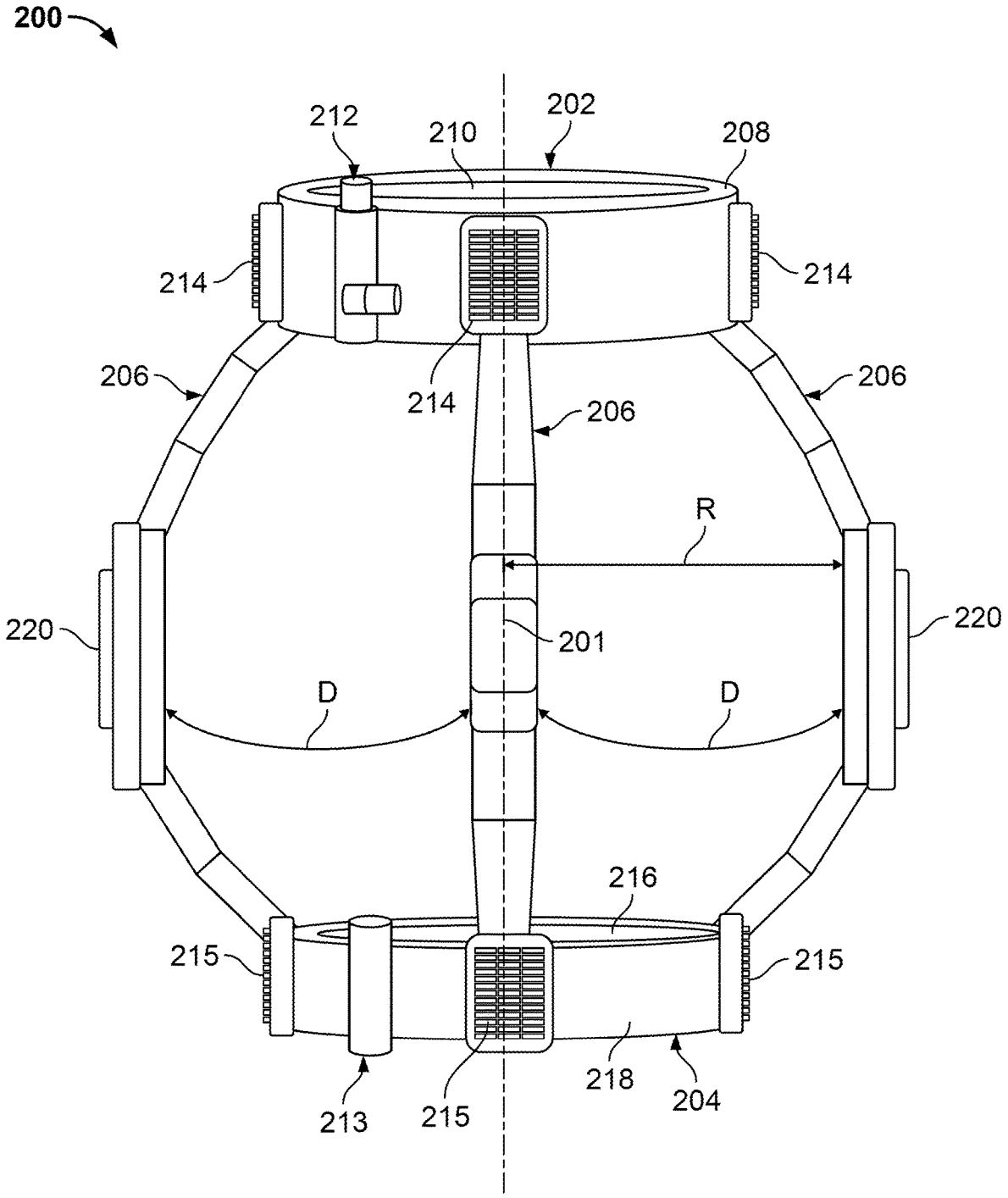
FIG. 2 is a schematic diagram of an example implementation of a centralizer tool for a wellbore tubular according to the present disclosure.

FIG. 2 is a schematic diagram of an example implementation of the centralizer tool 200 for a wellbore tubular according to the present disclosure. In this example implementation, the centralizer tool 200 includes a top clamp 202, a bottom clamp 204, and one or more (and, generally, multiple) bows 206 that connect the top and bottom clamps 202 and 204, respectively. Generally, each of the top clamp 202 and the bottom clamp 204 can be installed over and secured to a portion of a wellbore tubular (such as casing joint 63) by adjusting respective lock assemblies from unlocked to locked positions. In the locked positions, the top clamp 202 and the bottom clamp 204 can be secured to the wellbore tubular, which extends through a top bore 210 of the top clamp 202 and a bottom bore 216 of the bottom clamp 204 in an axial direction coincident with a centerline 201 of the respective bores 210 and 216.

Bows 206, generally, comprise curved and rigid members that extend radially outward from the top clamp 202 and the bottom clamp 204 as shown, as well as radially from the centerline 201 of the tool 200 a radius, R (which represents a largest distance between a bow 206 and the centerline 201). As also shown in FIG. 2, each bow 206 is radially offset from adjacent bows 206 by a radial distance, D. Although the example implementation of the centralizer tool 200 includes four bows 260 (each radially and equidistantly spaced by distance, D), alternative implementations of the centralizer tool 200 can have more (for example, six) or fewer (for example, three) bows 206.

As shown in FIG. 2, the top clamp 202 comprises a top ring 208 that, in this example, is a split ring that can open and close (and be locked in the closed position) by a top lock assembly 212. One or more (and in this example, four) sets of slips 214 are attached or integrally formed on an outer surface of the top ring 208. The slips 214, for instance, can include teeth or other profiled surface arranged to contact the wellbore 20 when the centralizer tool 200 is installed on the wellbore tubular and prevent or reduce movement of wellbore tubular in the wellbore 20.

Likewise, the bottom clamp 204 comprises a bottom ring 218 that, in this example, is a split ring that can open and close (and be locked in the closed position) by a bottom lock assembly 213. One or more (and in this example, four) sets of slips 215 are attached or integrally formed on an outer surface of the bottom ring 218 as well. The slips 215, for instance, can include teeth or other profiled surface arranged to contact the wellbore 20 when the centralizer tool 200 is installed on the wellbore tubular and prevent or reduce movement of wellbore tubular in the wellbore 20.

Figure 5B:
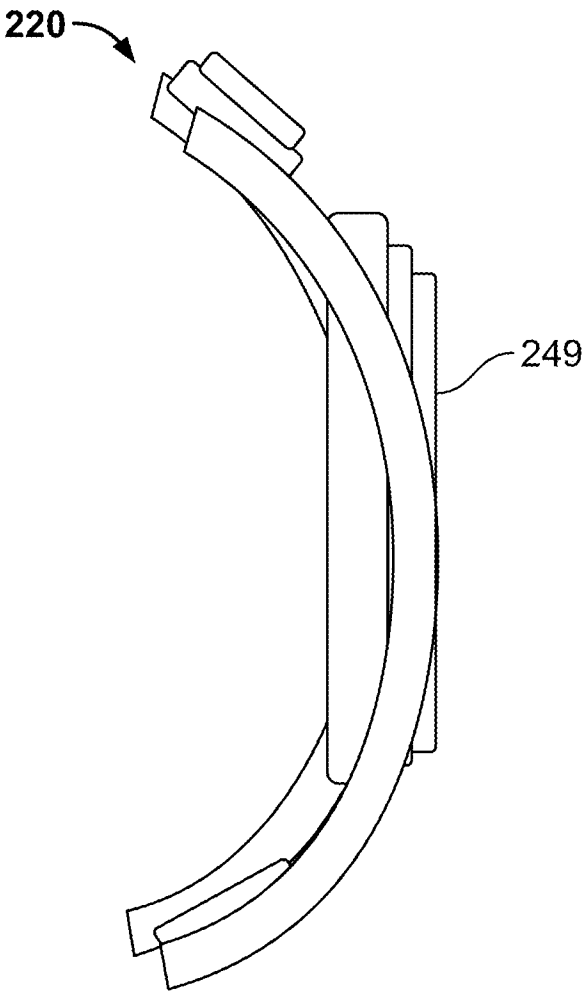
FIGS. 5A and 5B are schematic diagrams of an example implementation of a bow of a centralizer tool according to the present disclosure.
Figure 5A:
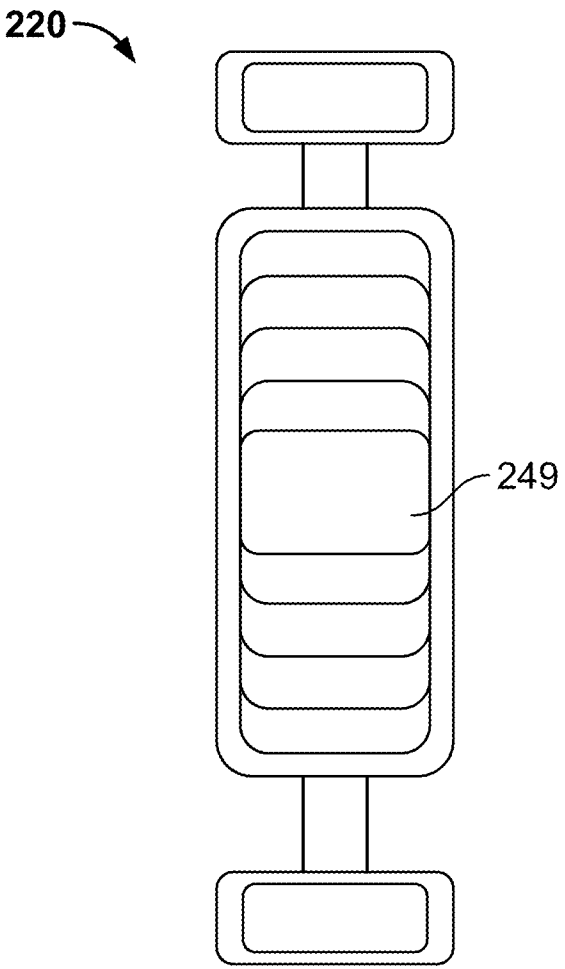

In example implementations as shown, and also with reference to FIGS. 5A and 5B, the bows 206 include a contact absorber 220 that is coupled or integrally formed with the bows 206. In this example, the contact absorber 220 is formed or attached at a midpoint of the bows 206 between the top clamp 202 and the bottom clamp 204. Generally, the contact absorbers 220 can include a contact surface 249 designed to contact the wellbore 20 and prevent damage to the centralizer tool 200, or unwanted contact to the wellbore tubular on which the centralizer tool 200 is installed, during installation of the production string 17 in the wellbore 20.

Figure 3A:
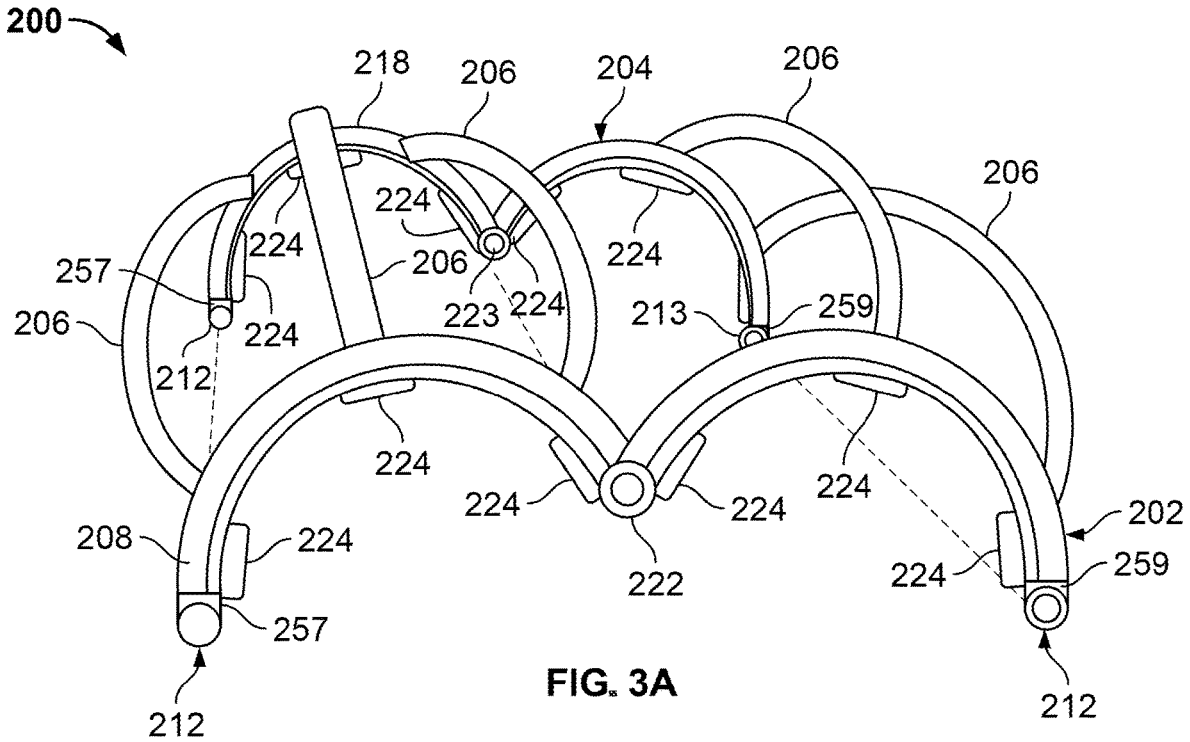
FIGS. 3A and 3B are schematic diagrams of an example implementation of a centralizer tool for a wellbore tubular in an open position and a closed position, respectively, according to the present disclosure.
Figure 3B:
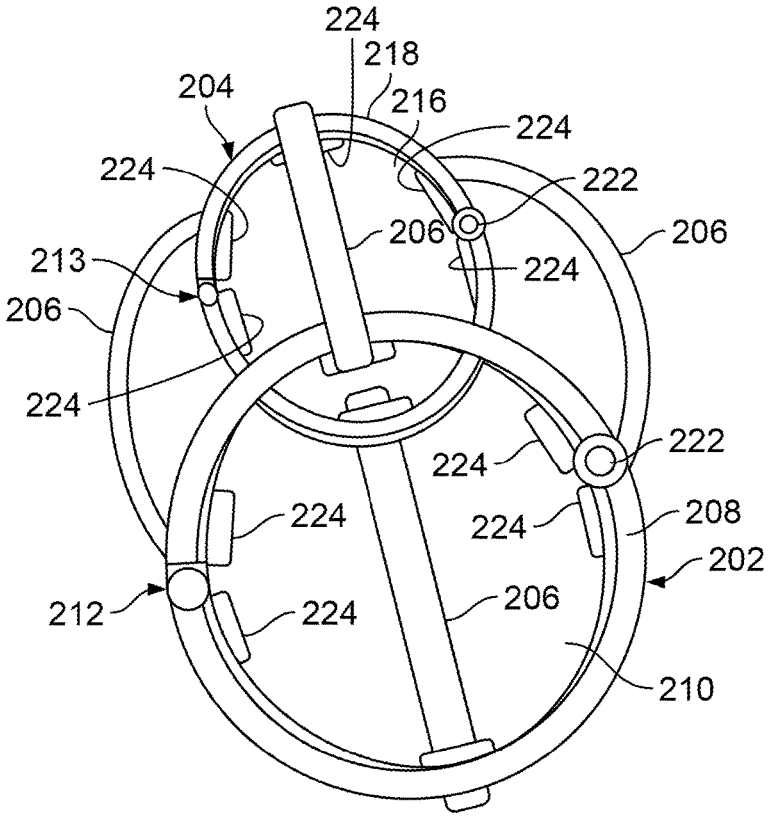

FIGS. 3A and 3B are schematic diagrams of an example implementation of a centralizer tool for a wellbore tubular in an open position and a closed position, respectively, according to the present disclosure. FIG. 3A shows the example centralizer tool 200 from an isometric top view with the centralizer tool 200 in an open position (in other words, ready to receive a wellbore tubular). FIG. 3B shows the example centralizer tool 200 from an isometric top view with the centralizer tool 200 in a closed position (in other words, once the wellbore tubular, not shown, has been secured in the centralizer tool 200). Turning to FIG. 3A, in the open position, the top lock assembly 212 and bottom lock assembly 213 are both in the unlocked position, thereby allowing the split rings of the top ring 208 and bottom ring 218 to open at respective hinges 222 and 223. As shown, hinge 222 allows the top ring 208 to open and accept a wellbore tubular into the bore 210, while hinge 223 allows the bottom ring 218 to open and accept a wellbore tubular into the bore 216.

As further shown in FIG. 3A, each split ring (the top ring 208 and the bottom ring 218) can include sets of slips 224 coupled to or integrally formed on inner surface of the respective rings 208 and 218. The slips 224, for instance, can include teeth or other profiled surface arranged to contact the wellbore tubular (such as casing joint 63) when the centralizer tool 200 is installed on the wellbore tubular and prevent or reduce movement of centralizer tool 200 on the wellbore tubular.

Figure 4C:
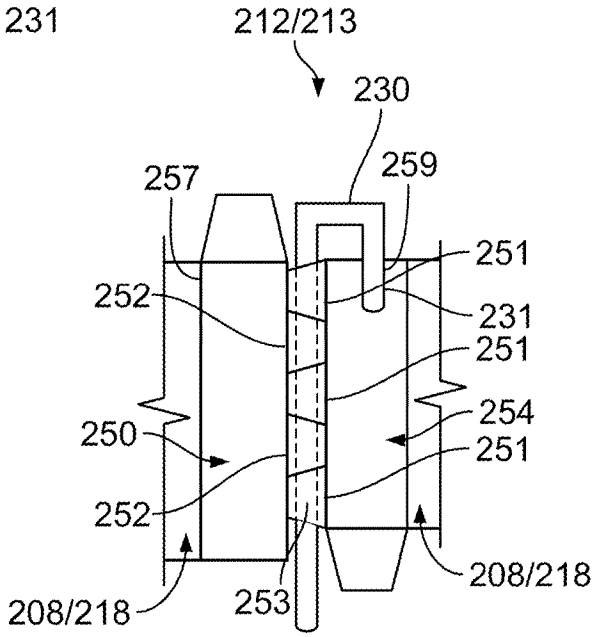
FIGS. 4A-4C are schematic diagrams of an example implementation of a lock assembly of a centralizer tool and process for locking the lock assembly according to the present disclosure.
Figure 4B:
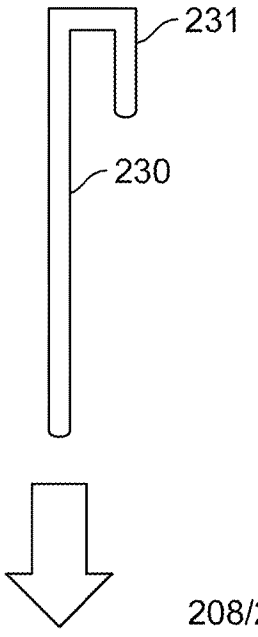
Figure 4B:
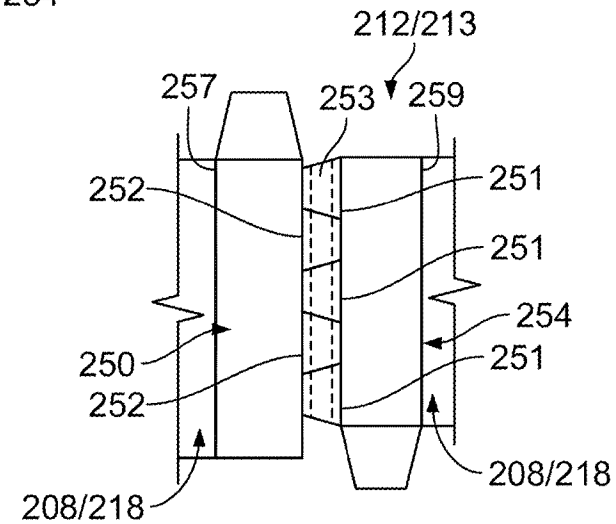
Figure 4A:
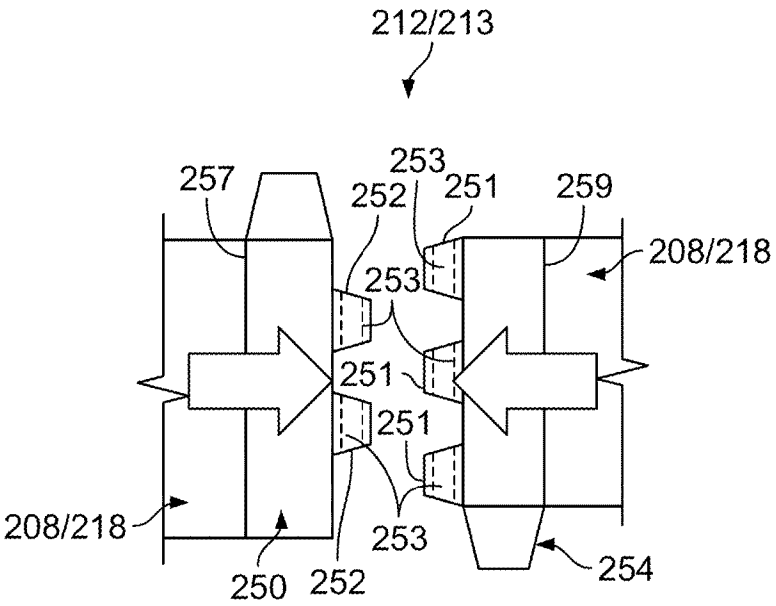

Turning to FIG. 3B, in the closed position, each of the top clamp 202 and the bottom clamp 204 are locked with respective locking assemblies 212 (on the top ring 208) and 213 (on the bottom ring 218). When locked, each split ring (the top ring 208 and the bottom ring 218) can be secured around and to the wellbore tubular (with securing contact also created, for instance, between the wellbore tubular and sets of slips 224). Turning briefly to FIGS. 4A-4C, these figures show schematic diagrams of an example implementation of the lock assembly 212 and lock assembly 213 of a centralizer tool and process for locking the lock assembly according to the present disclosure.

As shown, each lock assembly 212/213 includes a first lock plate 250 with sleeves 252 and a second lock plate 254 with sleeves 251. The first lock plate 250 is coupled to or formed with a first end 257 of top ring 208/bottom ring 218 (also shown in FIG. 3A). The second lock plate 254 is coupled to or formed with a second end 259 of top ring 208/bottom ring 218 (also shown in FIG. 3A). As shown in FIG. 3A, the first and second ends 257 and 259 are at open ends (opposite hinges 222 and 223) of the respective top ring 208 and bottom ring 218. Thus, in the open position of FIG. 3A, the first and second ends 257 and 259 are split apart to allow the wellbore tubular to be inserted into the top ring 208 and bottom ring 218.

FIG. 4A shows the lock assembly 212/213 in an unlocked position. In this position, for example, sleeves 252 (which each include a bore 253 therethrough) are not interconnected with sleeves 251 (which each include a bore 253 as well). As illustrated by the arrows in FIG. 4A, the first and second lock plates 250 and 254 are urged together to close the respective split rings of the top ring 208 and bottom ring 218, thereby resulting in the interlocking of first and second lock plates 250 and 254 as shown in FIG. 4B.

In the interlocked position, the respective bores 253 of the sleeves 252 and 251 align, thereby forming a single bore 253 that can receive pin 230 as shown in FIG. 4B. Pin 230 can be inserted into the single bore 253, thereby locking the first lock plate 250 with the second lock plate 254 (and thereby locking the top clamp 202/bottom clamp 204).

FIG. 4C shows the locking assembly 212/213 in the locked position, with the pin 230 inserted through the bore 253 and a U-leg 231 of the pin 230 hanging over the locked lock assembly 212/213. In some aspects, the U leg 231 can maintain or help maintain the pin 230 within the bore 253, thereby keeping the lock assembly 212/213 in the locked position even during movement of the centralizer tool 200 in the wellbore 20 or contact of the centralizer tool 200 with the rock formation in the wellbore 20.

In an example operation with one or more centralizer tools 200, and with reference to the figures, during make up of the production string 17 on the assembly 15, a wellbore tubular such as a casing joint 63 can be positioned on the assembly 15 and prepared to be run into the wellbore 20. Prior to running in the wellbore 20, one or more centralizer tools 200 can be installed on the casing joint 63. For each centralizer tool 200, the top and bottom clamps 202 and 204 can be opened (with the lock assemblies 212 and 213 in open positions as shown in FIG. 3A) to receive portions of the casing joint 63. Once received within the top clamp 202 and the bottom clamp 204, the centralizer tool 200 can be adjusted into the locked position as shown in FIG. 3B to secure the casing joint 63 into the centralizer tool 200. For instance, as shown in FIGS. 4A-4C, respective sleeves 252/251 of the first and second lock plates 250 and 254 can be interlocked and the pin 230 can be inserted into the bore 253. The respective ends 257 and 259 of the split rings (top ring 208 and bottom ring 218) are thereby joined together to secure the top clamp 202 and bottom clamp 204 onto the casing joint 63.

The casing joint 63 can then be run into the wellbore 20. During the running in operation, the bows 206 can prevent the casing joint 63 from contacting the wellbore 20 and help maintain the casing joint 63 radially centered within the wellbore 20. In some aspects, during running in, the sets of slips 214 and contact absorbers 220 bear and absorb contact between the centralizer tool 200 and the wellbore 20, thereby allowing the casing joint 63 to remain exclusive of contact with the wellbore 20. Further, during running in, the sets of slips 224 can maintain or help maintain the centralizer tool 200 secured on (and all or partially immobile on) the casing joint 63.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A centralizer tool, comprising:

a top clamp comprising a top split ring and a top lock assembly configured to adjust the top clamp from an unlocked position in which the top split ring is open to receive a first portion of a wellbore tubular and a locked position in which the top split ring is closed to secure the first portion of the wellbore tubular in the top clamp;

a bottom clamp comprising a bottom split ring and a bottom lock assembly configured to adjust the bottom clamp from an unlocked position in which the bottom split ring is open to receive a second portion of the wellbore tubular and a locked position in which the bottom split ring is closed to secure the second portion of the wellbore tubular in the bottom clamp; and at least one bow attached to the top split ring and the bottom split ring, the bow comprising a contact surface configured to contact a rock formation in a wellbore, wherein each of the top split ring and the bottom split ring comprises at least one outer slips that comprises a profiled surface and is coupled to an outer surface of the respective top split ring and bottom split ring and configured to contact the rock formation in the wellbore.

2. The centralizer tool of claim 1, wherein the at least one bow comprises a plurality of bows, each bow attached to the top split ring and the bottom split ring.

3. The centralizer tool of claim 2, wherein each bow of the plurality of bows is radially offset from adjacent bows by a particular distance.

4. The centralizer tool of claim 1, wherein a circumference defined by the contact surfaces of the plurality of bows is greater than a circumference defined by the top clamp in the locked position and a circumference defined by the bottom clamp in the locked position.

5. The centralizer tool of claim 1, wherein each of the top split ring and the bottom split ring comprises at least one inner slips coupled to an inner surface and configured to contact the wellbore tubular.

6. The centralizer tool of claim 1, wherein the top lock assembly comprises a first set of sleeves and a second set of sleeves and a first pin configured to fit through the first and second set of sleeves in an interlocked position to adjust the top clamp into the locked position, and the bottom lock assembly comprises a third set of sleeves and a fourth set of sleeves and a second pin configured to fit through the third and fourth set of sleeves in an interlocked position to adjust the bottom clamp into the locked position.

7. The centralizer tool of claim 6, wherein the first pin comprises a leg that forms a U to retain the first pin within the first and second sets of sleeves in the interlocked position, and the second pin comprises a leg that forms a U to retain the second pin within the third and fourth sets of sleeves in the interlocked position.

8. The centralizer tool of claim 6, wherein the top split ring comprises two half-rings joined by a top hinge, and the top lock assembly comprises the first set of sleeves connected to one of the two half rings and the second set of sleeves connected to the other of the two half-rings of the top split ring, and the bottom split ring comprises two half-rings joined by a bottom hinge, and the bottom lock assembly comprises the third set of sleeves connected to one of the two half rings and the fourth set of sleeves connected to the other of the two half-rings of the bottom split ring.

9. The centralizer tool of claim 1, wherein the wellbore tubular comprises a production casing joint.

10. The centralizer tool of claim 1, wherein the profiled surface comprises teeth.

11. The centralizer tool of claim 1, wherein the at least one bow comprises four bows, each bow attached to the top split ring and the bottom split ring.

12. The centralizer tool of claim 11, wherein the at least one outer slips comprises four outer slips corresponding to the four bows.

13. The centralizer tool of claim 12, wherein each of the four outer slips is coupled to the outer surface of the respective top split ring and bottom split ring at a location where a particular bow of the four bows connects to the respective top split ring and bottom split ring.

14. The centralizer tool of claim 12, wherein each bow of the four bows is radially offset from adjacent bows by 90 degrees.

15. The centralizer tool of claim 1, wherein the at least one outer slips that comprises the profiled surface is attached to or integrated with the outer surface of the respective top split ring and bottom split ring.

16. The centralizer tool of claim 1, wherein the at least one outer slips comprises eight outer slips, with four outer slips coupled to the top split ring and four outer slips coupled to the bottom slip ring.

17. The centralizer tool of claim 16, wherein each of the top split ring and the bottom split ring comprises at least one inner slips coupled to an inner surface and configured to contact the wellbore tubular.

18. The centralizer tool of claim 17, wherein the at least one inner slips comprises a plurality of inner slips coupled to the inner surface of the top split ring and a plurality of inner slips coupled to the inner surface of the bottom split ring.

* * * * *